US007278176B2

(12) United States Patent
Clarke

(10) Patent No.: US 7,278,176 B2
(45) Date of Patent: Oct. 9, 2007

(54) FIBERGLASS REINFORCED FIXTURE WITH FINISHED POLYMERIC CAP

(75) Inventor: Don H. Clarke, Colleyville, TX (US)

(73) Assignee: Clarke Products, Inc., Grand Prairie, TX (US)

( * ) Notice: Subject to any disclaimer, the term of this patent is extended or adjusted under 35 U.S.C. 154(b) by 362 days.

(21) Appl. No.: 10/158,708

(22) Filed: May 30, 2002

(65) Prior Publication Data

US 2004/0148696 A1 Aug. 5, 2004

(51) Int. Cl.
*A47K 1/04* (2006.01)

(52) U.S. Cl. ..... 4/619; 4/553; 4/593; 4/635; 4/660

(58) Field of Classification Search ..... 4/619, 4/553, 554, 538, 584, 593, 670, 624, 635, 4/660

See application file for complete search history.

(56) References Cited

U.S. PATENT DOCUMENTS 3,673,617 A * 7/1972 Schulz, Jr. ..... 4/631
3,720,540 A * 3/1973 Wimmer ..... 428/430
4,179,760 A * 12/1979 Nakagawa ..... 4/619
4,289,717 A * 9/1981 Bortz ..... 4/631
4,657,806 A * 4/1987 Dutt ..... 442/76
5,016,297 A * 5/1991 Sauter et al. ..... 4/619

* cited by examiner

*Primary Examiner*—Khoa D. Huynh
(74) *Attorney, Agent, or Firm*—Locke Liddell & Sapp, PLLC

(57) ABSTRACT

Polymeric plumbing fixtures such as sinks, lavatories and tubs are disclosed that comprise a thermoformed or molded interior shell having a top side with a relatively smooth, polymeric surface; a polymeric reinforcing layer bonded to the underside of the shell; and a thermoformed or polymeric cap nestably engageable with the underside of the reinforced shell. The cap cooperates with the shell to encapsulate the reinforcing layer and the reinforcing layer bonds the cap the shell to form a unitary structure. The polymeric cap thereby provides an attractive, finished surface on the underside of the resultant fixture. The structural configuration disclosed herein is particularly preferred for use in making kitchen sinks. A method for making the subject fixtures is also disclosed.

22 Claims, 3 Drawing Sheets

FIBERGLASS REINFORCED FIXTURE WITH FINISHED POLYMERIC CAP

BACKGROUND OF THE INVENTION

1. Field of the Invention

This invention relates to plumbing fixtures and, more particularly, to fixtures such as sinks, lavatories and tubs having a polymeric shell with a relatively smooth polymeric top surface, a fiberglass or foamed polymeric reinforcing layer bonded to the underside of the shell, and a thermoformed polymeric cap bonded to the underside of the reinforcing layer to encapsulate the reinforcing layer between the underside of the shell and the cap.

2. Description of Related Art

Plumbing fixtures made of fiberglass and various other polymeric materials have become recognized and widely used in recent years as lower-cost alternatives to conventional fixtures made of cast iron, aluminum, porcelain, and the like. Such polymeric fixtures include showers, tubs, sinks and lavatories used in both residential and commercial construction and remodeling. Polymeric fixtures can comprise one or more polymeric materials including, for example, acrylics, polyesters, polyurethanes, other thermoplastic, cross-linked or thermosetting copolymers or terpolymers of resins and rubbers, such as acrylonitrile butadiene styrene ("ABS"), and other materials that are effective for use in particular applications or for achieving desired properties. Unlike cast metal fixtures, which generally have smooth undersides, polymeric fixtures often have rough, "chopped back" undersides.

Many plumbing fixtures, and particularly sinks, are made with a relatively smooth, top surface that is reinforced with a fiberglass backing comprising chopped fibers distributed throughout a polymeric resin matrix. Such backings are frequently applied using a "chop gun" that combines polymeric resin and a catalyst with chopped fiber roving that is sprayed through a nozzle onto a substrate. Catalysts such as organic peroxides are added to the polymeric materials to promote cross-linking, bonding, curing or hardening of the polymers. Such products are sometimes criticized by consumers and retailers because of the rough and unfinished look that is typically visible on the underside of sinks or other fixtures made in this manner. A new product configuration and method of manufacture are therefore needed that will enable polymeric plumbing fixtures such as sinks, lavatories and tubs to be made cost effectively and reliably, and with finished underlying surfaces that are strong but more attractive and easy to clean.

SUMMARY OF THE INVENTION

Polymeric plumbing fixtures such as sinks, lavatories and tubs are disclosed that comprise a thermoformed or molded interior shell having a top side with a relatively smooth, polymeric surface; a polymeric reinforcing layer bonded to the underside of the shell; and a thermoformed or molded polymeric cap nestably engageable with the underside of the reinforced shell, the reinforcing layer bonding the cap and the shell to form a unitary structure. The polymeric cap encapsulates the reinforcing layer and provides an attractive finish to the undersides of the fixtures. The outside of the cap is desirably provided with at least some surface texturing and a plurality of convex, radially extending ribs are around the drain opening of the cap. The ribs allow headspace for any gasses trapped between the shell and cap when the cap is nested over the shell and provide additional rigidity and strength to the finished fixture.

According to one preferred embodiment of the invention, a plumbing fixture is provided that comprises a thermoformed acrylic shell of desired shape and thickness, a reinforcing layer comprising chopped fibers dispersed in a crosslinked polyester matrix that is bonded to the back side of the sanitary surface layer, and a thermoformed acrylic cap layer fitted over the reinforcing layer and bonded to the reinforcing layer opposite the underside of the shell. The cap cooperates with the shell to encapsulate the reinforcing layer and form a finished surface on the underside of the resultant fixture. The structural configuration disclosed herein is particularly preferred for use in making kitchen sinks.

According to another preferred embodiment of the invention, a method is disclosed for making a polymeric plumbing fixture, most preferably a sink, that comprises the steps of providing a molded or thermoformed polymeric shell; inverting the shell so that its underside is facing upwardly, applying a reinforcing layer to the upwardly facing underside of the shell, providing a molded or thermoformed cap having a shape and size that generally conform to the dimensions of the shell in such manner that the shell can be nested inside the cap; coating the interior surface of the cap with a polymeric resin; inverting the cap and forcing it downward onto the inverted underside of the shell so that the reinforcing layer is encapsulated between the shell and the cap; and thereafter curing the reinforcing layer between the assembled shell and cap so that the shell and cap are bonded into a unitary fixture.

According to a particularly preferred embodiment of the invention, a plurality of adjustment rails are also provided during manufacture of the fixture for use in attaching the fixture to a cabinet, counter or wall structure. With the prior art "chopped back" construction, the base portions of adjustment rails were simply embedded in the fiberglass sprayed onto the underside of the deck around a sink. With the structure disclosed herein, the flange portions of the adjustment rails can now be inserted through slots in that part of the cap aligned with the deck, thereby providing additional support holding support for the rails while sandwiching the flange portion of the rails between the shell and the cap to promote better bonding.

Through use of the structure and method disclosed herein, manufacturing efficiencies are achievable that can speed up production as compared to conventional chopped-back fixtures. Furthermore, the use of a polymeric cap as disclosed herein can help reduce the quantity of volatile organic compounds that must be captured during production.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
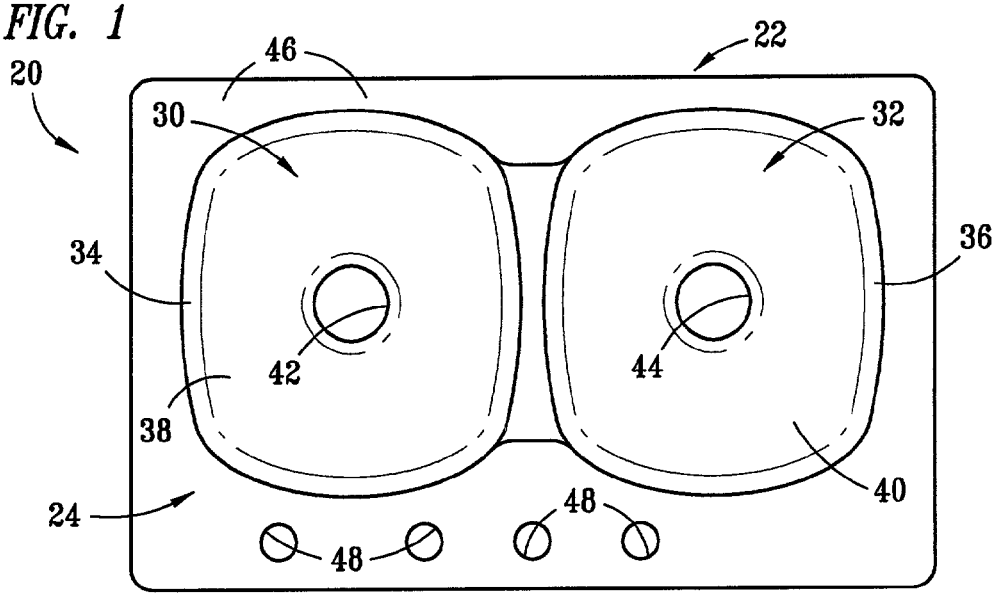
FIG. 1 is a top plan view of an assembled sink made in accordance with a preferred embodiment of the invention.

Referring to FIGS. 1-4, plumbing fixture 20, depicted in this embodiment as a kitchen sink 22, preferably comprises three separate layers that are bonded together to form a unitary structure. The top layer is shell 24, shown in FIG. 1, which includes all surfaces of sink 22 that are visible when sink 22 is viewed from above as installed. The bottom layer is cap 26, shown in FIG. 3, which includes all surfaces of sink 22 that are visible when sink 22 is viewed from below as installed. Shell 24 and cap 26 are preferably formed of such size and shape that shell 24 can nest inside cap 26 with room therebetween for an intermediate layer 28, as described below in relation to FIGS. 4-6. Intermediate layer 28 is disposed between shell 24 and cap 26, and preferably comprises chopped fiberglass or a foamed polymeric material applied in such manner that it bonds shell 24 and cap 26 into a unitary fixture 20. Such bonding can be achieved by selecting compatible polymeric materials and appropriate curing or cross-linking agents, or by the use of additional adhesive layers between intermediate layer 28 and the adjacent walls of shell 24 and cap 26.

Shell 24 of sink 22 can be made with a single sink well but preferably comprises double sink wells 30, 32, each having side walls 34, 36, a bottom wall 38, 40, and a drain hole 42, 44 respectively. Sink wells 30, 32 are preferably surrounded and separated by a substantially horizontal top deck 46 that is formed continuously with sink wells 30, 32 and comprises a plurality of apertures 48 adapted to receive such faucet and sprayer hardware, not shown, as may be desired. Drain holes 42, 44 and apertures 48 are preferably created in shell 24 by a bore saw or other similarly effective means following the bonding of shell 24 to cap 26. Shell 24 is desirably thermoformed from an extruded or calendered sheet of a suitable polymeric material but can also be formed by other similarly effective means such as molding. A particularly preferred polymeric material for forming shell 24 is a continuous or cell-cast cross-linked acrylic that is heat cured to the desired degree of cross-linking. One such material is an acrylic polymer marketed under the trademark LUCITE® by Du Pont. LUCITE® polymers are reported to be acrylic resins consisting of a series of polymeric esters of methacrylic acid. When shell 24 is thermoformed from an acrylic sheet material, the thickness of the extruded sheet preferably ranges from about 0.080 to about 0.187 inches. In addition to the base polymer, it will be appreciated that other known polymeric additives such as coloring pigments and the like can also be incorporated into the polymeric sheet within the scope of the present invention.

Figure 2:
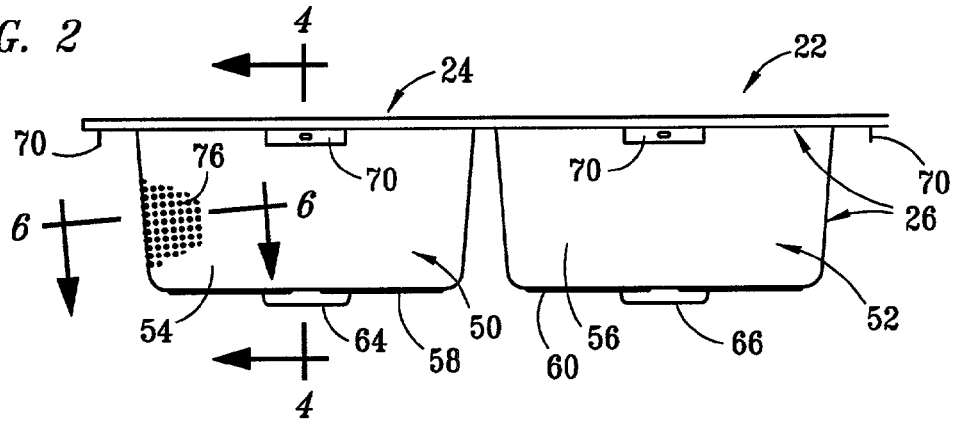
FIG. 2 is a front elevation view of the sink of FIG. 1.
Figure 3:
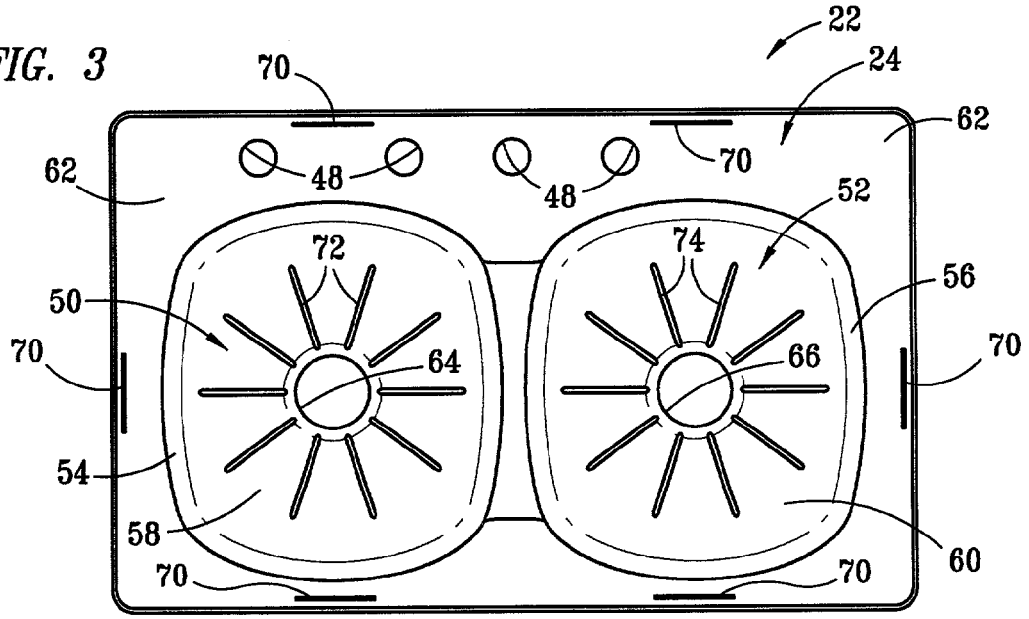
FIG. 3 is a bottom plan view of the sink of FIG. 1.
Figure 5:
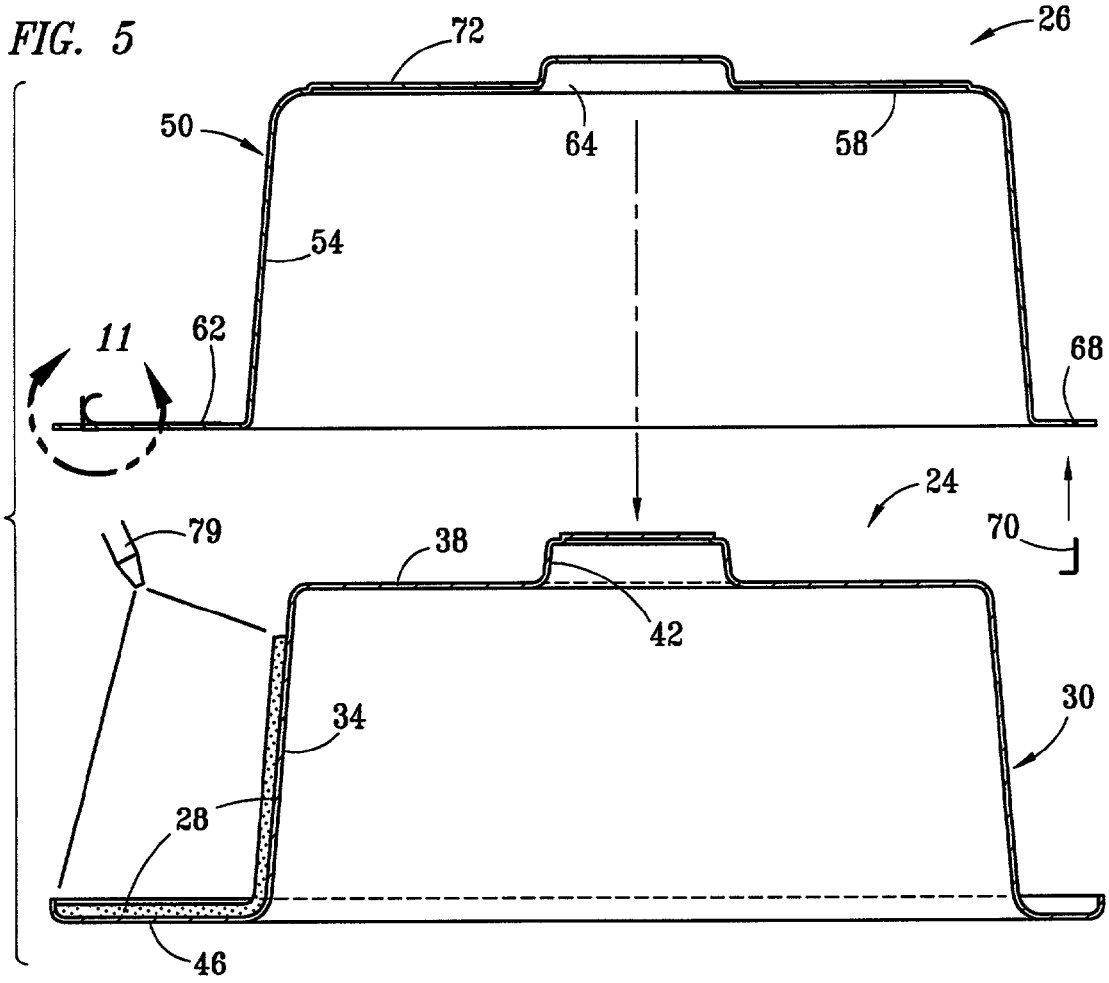
FIG. 5 is an exploded, cross-sectional side elevation view of a sink being made in accordance with the method of the invention.

Referring to FIGS. 2, 3 and 5, cap 26 preferably comprises sink wells 50, 52 that are slightly larger than sink wells 30, 32, respectively. Sink wells 50, 52 preferably further comprise side walls 54, 56, bottom walls 58, 60, and a continuously formed, substantially horizontal bottom deck 62 surrounding and separating sink wells 50, 52. Bottom walls 58, 60 each comprise a drain hole 64, 66 that is cooperatively sized and alignable with drain holes 42, 44 of sink wells 30, 32. A plurality of elongate slots 68 are preferably disposed in spaced-apart relation around the periphery of bottom deck 62 to permit the insertion of adjustment rails 70 through cap 26 prior to assembly of sink 22 as discussed below. Adjustment rails 70 are visible in FIG. 2, where they extend downward from the underside of bottom deck 62 around its perimeter to facilitate the attachment of sink 22 to a counter, cabinet or wall structure during the installation of sink 22. Each adjustment rail preferably comprises at least one aperture, as discussed below, that is adapted to receive a fastener when installing sink 22.

Like shell 24, cap 26 is preferably thermoformed or molded from an extruded or calendered polymeric sheet. The thickness of the sheet used to form cap 26 preferably ranges from about 0.030 to about 0.125 inches, and most preferably from about 0.030 to about 0.080 inches. According to one preferred embodiment of the invention, cap 26 is made of a continuous or cell-cast, cross-linked acrylic sheet. The use of acrylic resins in making shell 24 and cap 26 is preferred because of their appearance, durability and processability, and because they bond well with the fiberglass material used in making the intermediate layer 28 between shell 24 and cap 26. Another example of a polymeric material that can be used in making cap 26 is acrylonitrile-butadiene-styrene ("ABS"), a very durable polymer. ABS can be used alone or can be coextruded, for example, with a layer comprising an acrylic DR resin (containing butyl rubber). Other similarly effective polymeric sheet materials and laminates can likewise be used within the scope of the invention.

Figure 4:
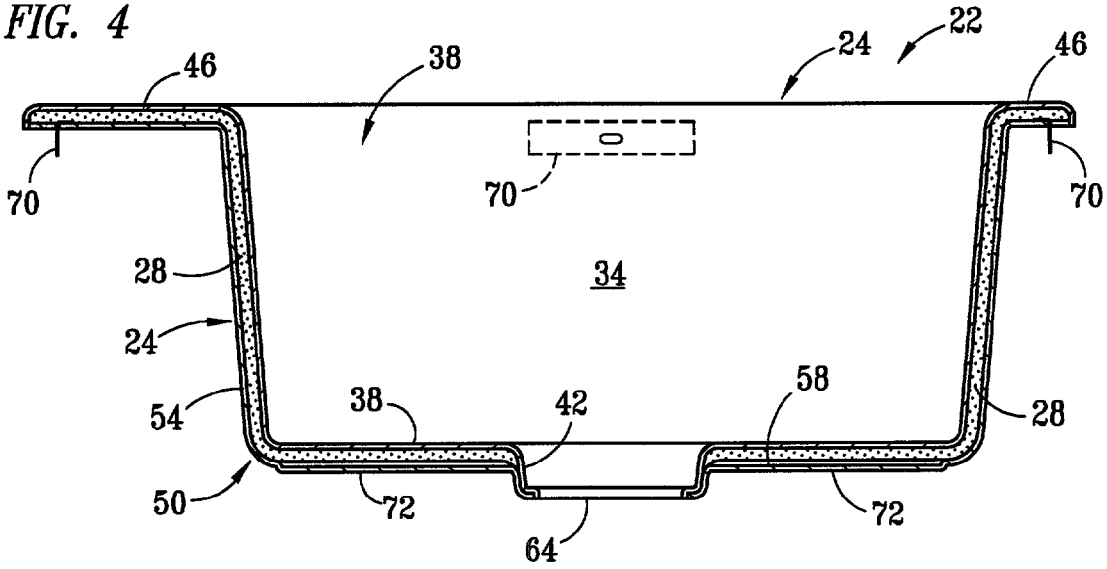
FIG. 4 is a cross-sectional elevation view taken along line 4-4 of FIG. 1.
Figure 6:
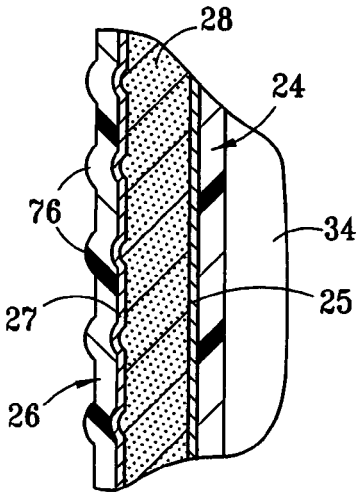
FIG. 6 is a cross-sectional detail view taken along line 6-6 of FIG. 2.
Figure 7:
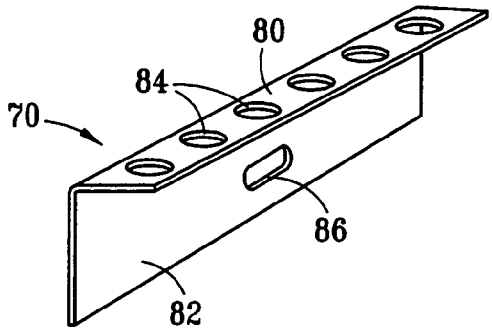
FIG. 7 is a perspective view of an adjustment rail that is attachable to a sink made according to a preferred embodiment of the invention for use in attaching the sink to a cabinet during installation.
Figure 8:
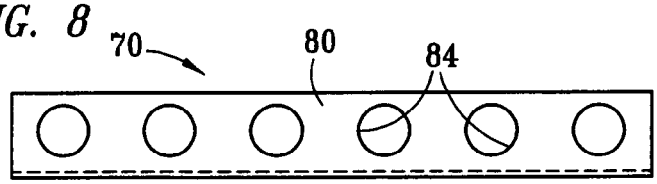
FIG. 8 is a top plan view of the adjustment rail of FIG. 7.
Figure 9:
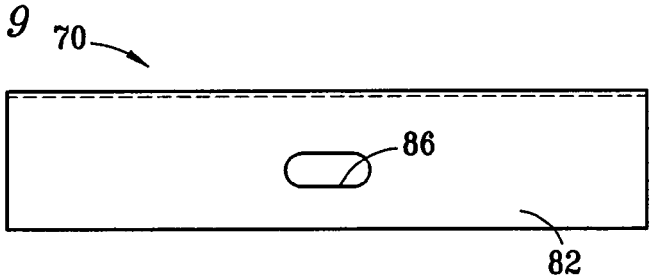
FIG. 9 is a front elevation view of the adjustment rail of FIGS. 7 and 8.
Figure 10:
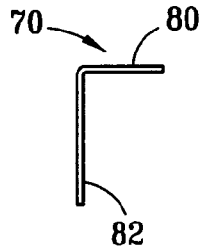
FIG. 10 is a left side elevation view of the adjustment rail of FIG. 9.
Figure 11:
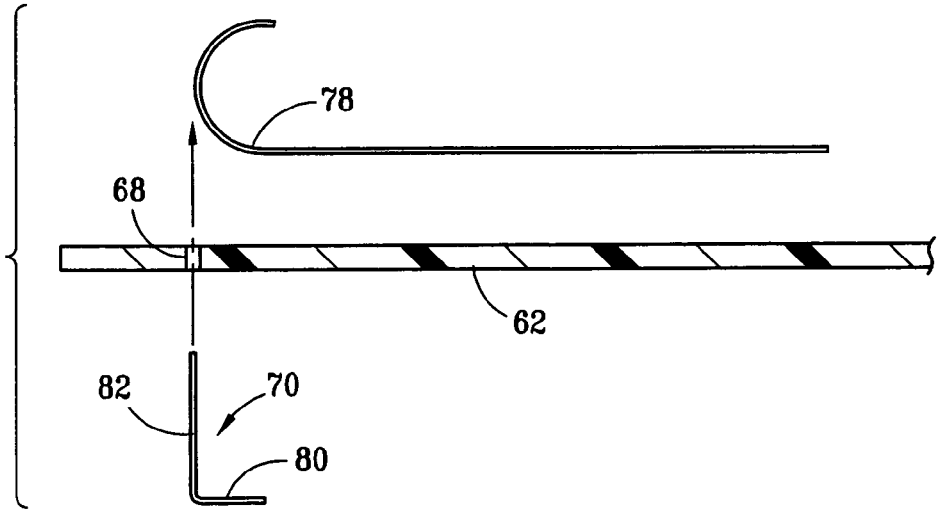
FIG. 11 is a detail view of the rail as installed in the cap prior to assembly, taken from FIG. 5.

Referring to FIGS. 4-6, shell 24 is preferably thermoformed in a desired size and configuration from extruded acrylic sheet using conventional thermoforming equipment well known to those of skill in the art. After forming, shell 24 is desirably inverted to the position shown in FIG. 5 for application of a fiberglass intermediate layer 28 before drain holes 42, 44 and apertures 48 are cut out of the shell. This prevents the fiberglass from being sprayed through the drain hole and apertures during application of intermediate layer 28, thereby spoiling the smooth sanitary surface of shell 24. Once shell 24 is inverted to the position shown in FIG. 5, intermediate layer 28 is desirably applied over the upwardly facing underside of the shell. Intermediate layer 28 is preferably applied using chop gun 79, which sprays a mixture comprising three principal components onto shell 24. According to a particularly preferred embodiment of the invention, intermediate layer 28 comprises a polyester resin, a cross-linking catalyst, and a reinforcing fiber such as chopped fiberglass gun roving. The polyester resin is desirably in the form of a sprayable liquid that provides a continuous matrix into which the glass fiber is dispersed during spraying. The cross-linking catalyst, preferably a compatible organic peroxide, causes the polyester resin to set up or harden more quickly, and also promotes bonding of the polyester resin to the surfaces of shell 24 and cap 26. Instead of polyester resin, other similarly effective cross-linkable or thermosetting polymeric materials can also be used in forming intermediate layer 28 within the scope of the invention. Thus, for example, epoxy, polyurethane foam, and various combinations of foamed polymer and chopped fiber can also be used within the scope of the invention so long as the resultant intermediate layer 28 provides strength and rigidity to sink 22 or other fixture 20 and can also bond to both shell 24 and cap 26. Other similarly effective filler materials can likewise be used within the scope of the invention. Referring to FIG. 6, where the principal material used in making intermediate layer 28 will not itself bond to shell 24 or cap 26, another adhesive material 25, 27 can be used to pre-coat the contacting surfaces of both shell 24 and cap 26, respectively, to achieve bonding. In such case it is important that the selected adhesive material also be capable of bonding to the principal material of intermediate layer 28 in order to achieve structural integrity between shell 24 and cap 26. The materials used in forming intermediate layer 28 will desirably not adversely react with or otherwise degrade the properties of the polymers used to form shell 24 and cap 26. Although FIG. 5 only depicts a portion of inverted shell 24 being covered with intermediate layer 28, it is understood that the entire exposed surface of shell 24 is desirably covered in like manner before assembling cap 26 to shell 24.

In preparation for bonding of cap 26 to intermediate layer 28 on shell 24, cap 26 is preferably thermoformed, trimmed, bored for drain holes 64, 66, and then coated lightly with a mixture of the polyester resin and cross-linking catalyst. Boring drain holes 64, 66 prior to assembly of cap 26 to shell 24 facilitates venting most of the air that might otherwise be trapped between the two parts. Adjustment rails 70 are also desirably pre-installed in cap 26 prior to placement over shell 24 and intermediate layer 28. Referring to FIGS. 5 and 7-11, adjustment rails 70 preferably comprise elongate, L-shaped metal brackets having a base portion 80 and a flange portion 82 that are mutually perpendicular and joined along one edge. Flange portion 82 is desirably inserted through one of elongate slots 68 and base portion 80 is preferably seated flush against deck 62. Removable tape strips 78 or other similarly effective means can be used to hold adjustment rails 70 in this position temporarily until cap 26 is installed in place over shell 24. Base portion 80 preferably comprises a plurality of longitudinally spaced apertures 84 that provide a better interlock with the material used to make intermediate layer 28 when shell 24 and cap 26 are assembled. Flange portion 82 preferably comprises at least one elongate slot 86 or a plurality of spaced apertures, not shown, to receive and facilitate adjustment in positioning of a fastener during installation of sink 22. Finally, spraying the interior surfaces of sink wells 50, 52 with the same resin and cross-linking agent used for forming intermediate layer 28, but without the chopped fiber, just prior to assembly will facilitate bonding of cap 26 to intermediate layer 28.

Soon after application of intermediate layer 28 to the inverted bottom, side walls and deck of shell 24, preformed and pre-coated cap 26 is desirably inverted in alignment with shell 24 and placed downwardly over coated shell 24, pressing cap 26 into place to seat cap 26 in contacting engagement with intermediate layer 28 and promote bonding between intermediate layer 28 and the interior surfaces of cap 26. The interval between the time that intermediate layer 28 is applied to the upwardly facing underside of shell 24 and the time that inverted cap is installed downwardly over shell 24 is preferably short so that intermediate layer 28 will not have cured, hardened or set up to the point where it will not bond with cap 26.

Referring to FIGS. 3-5, according to a particularly preferred embodiment of the invention, bottom walls 58, 60 of sink wells 50, 52 each further comprise a plurality of thermoformed or molded ribs 72, 74 that are spaced apart from and extend radially outward from drain holes 64, 66, respectively. Ribs 72, 74 protrude outwardly and create elongate concave spaces on the opposite side of bottom walls 58, 60 between shell 24 and cap 26 of assembled sink 22 in which any remaining entrapped air or volatile gases rising from the intermediate layer can be captured when cap 26 is applied over shell 24 during and after assembly of sink 22.

Referring to FIGS. 2 and 6, surface texturing such as dimples 76 or other desired shapes can optionally be formed into cap 26 when sink 22 or other fixture 20 is formed, thereby enhancing the visual appearance of the outside surface of cap 26 and simultaneously providing greater bonding surface and a stronger interlock between cap 26 and intermediate layer 28.

Once shell 24 and cap 26 are joined as described above, they are desirably allowed to set or cure under ambient conditions for approximately 45 minutes prior to further handling. It should be understood that the time required for curing will vary according to factors such as the materials used, the thickness of intermediate layer 28, and the ambient temperature. Where the ambient temperature is below about 50° F., it may be desirable to expose the assembled sinks 22 or other fixtures 20 to radiant heaters, heat lamps or other similarly effective means for a few minutes to promote cross-linking or bonding.

It will be apparent to those of ordinary skill in the art upon reading this disclosure that other similarly effective polymeric materials can also be used in forming shell 24 and cap 26 of the invention in place of the preferred acrylics disclosed herein. In this respect, the present invention resides in the fact that a preformed polymeric shell is coated on its underside with one or more materials that will form an intermediate layer that is then covered with a preformed cap made to nest over the shell, thereby capturing and encapsulating the intermediate layer therebetween, except where apertures are provided for ancillary hardware, etc. In the finished product, both shell 24 and cap 26 are desirably bonded to the intermediate layer to form a unitary sink 22 or other fixture 20.

Although not shown in the drawings, it should also be understood that shell 24 can comprise excess material around the perimeter of deck 46 that is trimmed away following the application of intermediate layer 28 and assembly to cap 26. Such trimming is conveniently done at or about the time that drain holes 42, 44 and apertures 48 are cut out of shell 24 of sink 22.

Other alterations and modifications of the invention will likewise become apparent to those of ordinary skill in the art upon reading the present disclosure, and it is intended that the scope of the invention disclosed herein be limited only by the broadest interpretation of the appended claims to which the inventor is legally entitled.

The invention claim is:

1. A polymeric plumbing fixture having a desired configuration, the fixture comprising:

a continuous polymeric shell thermoformed from an extruded, calendered or cast polymeric sheet, said shell having a predetermined shape and size, and an underside;

a continuous polymeric cap thermoformed from an extruded, calendered or cast polymeric sheet, said cap substantially conforming to the shape and size of the shell;

a substantial portion of the shell being nestable inside a substantial portion of the cap;

and an intermediate layer applied to the underside of the shell while the shell is inverted, the intermediate layer comprising a cross-linkable polyester resin, a cross-linking agent and a chopped fibrous filler that bonds the shell, cap and intermediate layer into an integral structure conforming to the desired configuration of the fixture when the cap is inverted and pressed into seated, contacting engagement with the intermediate layer and cured.

2. The fixture of claim 1 wherein the fixture is a sink.

3. The fixture of claim 1 wherein the chopped fibrous filler is fiberglass roving.

4. The fixture of claim 1 wherein the intermediate layer comprises epoxy.

5. The fixture of claim 1 wherein the shell is thermoformed from an acrylic polymeric sheet.

6. The fixture of claim 5 wherein the polymeric sheet has a thickness ranging from about 0.080 to about 0.187 inches.

7. The fixture of claim 1 wherein the cap is thermoformed from an acrylic polymeric sheet.

8. The fixture of claim 7 wherein the cap is thermoformed from an acrylic polymeric sheet having a thickness ranging from about 0.030 to about 0.125 inches.

9. The fixture of claim 8 wherein the thickness of the acrylic polymeric sheet ranges from about 0.060 to about 0.080 inches.

10. The fixture of claim 1 wherein the shell is made with a cell-cast acrylic.

11. The fixture of claim 1 wherein the cap is made with a cell-cast acrylic.

12. The fixture of claim 1 wherein the cross-linking agent is an organic peroxide.

13. The fixture of claim 1 wherein the cap comprises acrylonitrile butadiene styrene.

14. The fixture of claim 1 wherein the cap comprises an acrylic polymer containing butyl rubber.

15. The fixture of claim 1, further comprising an adhesive layer disposed between the shell and the intermediate layer.

16. The fixture of claim 1, further comprising an adhesive layer disposed between the cap and the intermediate layer.

17. The fixture of claim 2, further comprising a plurality of adjustment rails.

18. The fixture of claim 17 wherein each adjustment rail comprises a base portion and a flange portion.

19. The fixture of claim 1 wherein the intermediate layer is rigid when cured.

20. The fixture of claim 18 wherein the cap further comprises a plurality of spaced-apart elongate slots adapted to receive the flange portion of the adjustment rails.

21. The fixture of claim 1 wherein the cap further comprises a plurality of ribs providing additional space between the intermediate layer and the cap.

22. The fixture of claim 1 wherein the cap further comprises surface texturing.

* * * * *